United States Patent [19]

Kodama et al.

[11] Patent Number: 4,544,019

[45] Date of Patent: Oct. 1, 1985

[54] METHOD AND APPARATUS FOR MANUFACTURING COMPOSITE STEEL INGOT

[75] Inventors: Hideyo Kodama; Yasuo Kondo; Kimihiko Akahori, all of Katsuta, Japan

[73] Assignee: Hitachi, Ltd., Tokyo, Japan

[21] Appl. No.: 493,703

[22] Filed: May 11, 1983

[30] Foreign Application Priority Data

May 14, 1982 [JP] Japan ..... 57-79859

[51] Int. Cl.[4] ..... B22D 27/02

[52] U.S. Cl. ..... 164/496; 164/468; 164/497; 164/504; 164/509

[58] Field of Search ..... 164/469–470, 164/495–497, 508–509, 514–515

[56] References Cited

U.S. PATENT DOCUMENTS 3,152,372 10/1964 Hopkins ..... 164/497
3,482,259 12/1969 Schwarz ..... 164/470
3,807,486 4/1974 Paton et al. ..... 164/497

FOREIGN PATENT DOCUMENTS 54-118332 9/1979 Japan ..... 164/495

*Primary Examiner*—Nicholas P. Godici
*Assistant Examiner*—Richard K. Seidel
*Attorney, Agent, or Firm*—Antonelli, Terry & Wands

[57] ABSTRACT

This invention is in a method of manufacturing a composite steel ingot wherein a consumable electrode is inserted into an empty space positioned concentrically with said steel ingot, and electric power is fed to said consumable electrode to effect electroslag remelting under a slag bath and then to solidify the molten metal, while taking out an electric current through a plurality of collecting electrodes which are electrically connected to said steel ingot placed on a surface plate, the improvement in that a flow path of the electric current passing from said consumable electrode to said collecting electrodes is moved in the circumferential direction of said steel ingot during said electroslag remelting.

23 Claims, 7 Drawing Figures

METHOD AND APPARATUS FOR MANUFACTURING COMPOSITE STEEL INGOT

BACKGROUND OF THE INVENTION

1. Field of the Invention

This invention relates to a method and an apparatus for manufacturing composite steel ingots, and more particularly to a method and an apparatus suitable for filling metals in the empty portion of a hollow steel ingot or the outer peripheral portion of a steel ingot through electroslag remelting thereby to form a composite steel ingot.

This invention is applicable to rolls for rolling and rollers for guiding rolled materials both of which are used in rolling facilities, rollers for guiding steel ingots used in continuous casting machines, rotor shafts for generators, and other shafts for various uses.

2. Description of the Prior Art

It is disclosed in Japanese Patent Laid Open No. 57-36087 to rotate a cylndrical steel ingot, when carrying out pad welding on the cylindrical steel ingot by the use of an electroslag welding method which has the same principle as that of an electroslag remelting method. In this method, a plurality of consumable electrodes are employed and an electric current is taken out from one point of the steel ingot. A problem which occurs with the known method is that the density of melting current becomes nonuniform. In the embodiment disclosed in the above Laid Open Patent, the cylindrical steel ingot is rotated at a constant speed of 1 rpm during the process of welding.

SUMMARY OF THE INVENTION

Objects of the Invention

It is an object of this invention to provide a method and an apparatus for manufacturing composite steel ingots wherein an empty space positioned concentrically with the steel ingot is filled with molten metals through electroslag remelting, which can improve uniformity in fusion depth of the steel ingot in the horizontal direction.

Another object of this invention is to provide a method and an apparatus for manufacturing composite steel ingots which can improve uniformity in fusion depth of the steel ingot in the horizontal direction as well as in the vertical direction.

Statement of the Invention

The method of this invention is related to such a method that a consumable electrode is inserted into an empty space positioned concentrically with the steel ingot, and electric power is fed to the consumable electrode to effect electroslag remelting under a slag bath and then to solidify the molten metal, while taking out an electric current through a plurality of collecting electrodes which are electrically connected to the steel ingot placed on a surface plate, and it is basically featured in that a flow path of the electric current is moved in the circumferential direction of the steel ingot during the electroslag remelting.

In order to fill an empty space with molten metals, a steel ingot is placed on a surface plate and the empty space is positioned concentrically with the steel ingot. The empty space positioned concentrically with the steel ingot is given by, for example, an empty space of steel ingots which are hollow, or an empty space which is formed between a steel ingot and a mold by surrounding the steel ingot with the mold. The term "concentrically" includes the meaning of "precisely concentric relation" as well as "nearly concentric relation".

Electroslag remelting is usually carried out in such a manner that the leading end of a consumable electrode is inserted into a slag bath retained within the empty space, and that electric power is fed across the consumable electrode and a plurality of collecting electrodes through the slag bath, while taking an electric current from the plural collecting electrodes which are electrically connected to the steel ingot. Both the consumed electrode and the wall surface of empty space of the steel ingot are molten due to resistance heat of the slag bath, and the empty space is filled with a mixture of molten metals of the consumed electrode and the steel ingot from the bottom to the top, thus resulting in a composite steel ingot.

In general, when composite steel ingots are manufactured through such electroslag remelting, a fusion depth of the steel ingot becomes nonuniform in the horizontal direction.

It has been found that the reason why a horizontal fusion depth of the steel ingot becomes nonuniform is that the density of melting current loses its uniformity because of the presence of plural collecting electrodes, and hence there occurs nonuniformity in temperature of the slag bath. In the electroslag remelting method, a plurality of collecting electrodes are disposed on the outer periphery of the steel ingot on a surface plate on which the former is placed, thereby to form electric circuits through which an electric current passes from the consumable electrode to the plural collecting electrodes via the slag bath. The current has a tendency to flow through the electric circuit having the shortest distance with priority. Therefore, even in case of using the plural collecting electrodes, electric currents passing through the respective electrodes become nonuniform and this causes partial currents, so that it is unavoidable for a melting current to undergo nonuniformity in its density. Such nonuniformity in density of melting current locally increases temperature of the slag bath near the portion which has the higher density of melting current, whereby the steel ingot in the vicinity of that portion assumes the maximum fusion depth and hence a horizontal fusion depth of the steel ingot becomes nonuniform. As a result of nonuniformity in the horizontal fushion depth of the steel ingot, there occurs a deflection in the content of chemical components contained in the resultant composite steel ingot, or a variation in the texture thereof. In the worst case, slag may be involved in the interface between the steel ingot and the molten metal.

In this invention, to improve uniformity in horizontal fusion of the steel ingot, a flow path of the electric current passing from the consumable electrode to the collecting electrodes is moved in the circumferential direction of the steel ingot for at least one period during the process of electroslag remelting. By so doing, the nonuniform portion of melting current density is equally distributed in the circumferential direction of the steel ingot. Thus, even with the presence of nonuniformity in density of melting current itself, the caloric value transmitted from the slag bath to the steel ingot is averaged looking at the entire steel ingot, and hence uniformity in horizontal fusion of the steel ingot is improved.

The flow path of the electric current passing from the consumed electrode to the collecting electrodes can be moved by rotating the collecting electrodes in the circumferential direction of the steel ingot, or by rotating the steel ingot in the circumferential direction thereof. Both rotations may be used combinedly. It is also a matter of course that the method for moving the flow path of the electric current is not limited to such ones, and any other suitable method may be utilized if possible.

The rotating direction of the steel ingot or the collecting electrodes can be selected optionally if that direction corresponds to the circumferential direction of the steel ingot. In this invention, since nonuniformity in density of melting current does not impair uniformity of horizontal fusion of the steel ingot, it is not required to pay particular consideration on arrangement or layout of the collecting electrodes.

It is preferable that a gap width between the wall surface of the empty space of the steel ingot and the consumable electrode is set to be 20 mm at minimum. If the gap width is less than 20 mm, an arc will be produced between the electrode and the wall surface of the empty space of the steel ingot, so that a fusion depth becomes too large at the arc produced portion. As a result, uniformity in horizontal fusion tends to be impaired. More preferably, the aforesaid gap width should be set to be greater than 30 mm. It is also preferred that a horizontal spacing (D) of the empty space and a horizontal thickness (d) of the consumable electrode are selected to meet the relationship of $d/D=0.2\sim0.8$, provided that the minimum gap width from the wall surface of the empty space to the electrode shall not be lower than 20 mm. If the value of d/D is too small, a speed of filling the empty space becomes slow, thus resulting in the reduced productivity of composite steel ingots. From this reason, the value of d/D is preferably set to be no less than 0.2. As the value of d/D is increased gradually, the action of cleaning the electrode material due to the slag bath is weakened correspondingly, whereby a heat transfer rate from the slag bath to the electrode is lowered and hence melting of the electrode becomes more difficult. From this reason, the value of d/D is preferably set to be no greater than 0.8.

When filling the empty space formed in a hollow steel ingot, the number of revolutions N (rpm) of the steel ingot or the collecting electrodes and a spacing L (cm) of the empty space are selected to meet the relationship of $60\leqq LN\leqq 2000$.

On the other hand, when filling the empty space formed in the outer peripheral portion of a steel ingot, it is preferred that the number of revolutions N (cm) of the steel ingot or the collecting electrodes and a diameter L (cm) of the steel ingot are selected to meet the relationship of $60\leqq LN\leqq 2000$.

If the value of LN is less than 60, a degree of the effect becomes insufficient for correction of nonuniformity in horizontal fusion depth of the steel ingot because of nonuniformity in density of the melting current. To the contrary, if the value of LN is too large, the surface of the slag bath is fluctuated in the form of a wave and there occurs an involvement of slag or a local arc, so that refusion tends to be unstable. From this reason, the value of LN is preferably set to be no greater than 2000.

When filling the empty space of a hollow steel ingot with molten metals, heat is radiated from the steel ingot more effectively than the case of forming an outward pad, so that a fusion depth tends to be smaller. As for forming of an inward pad, therefore, the number of revolutions is preferably set to be less than that for forming of an outward pad. In other words, a desired range of the LN value is from 50 to 240 in case of forming an inward pad, while a desired range of the LN value is from 180 to 720 in case of forming an outward pad.

Controlling the value of LN within the foregoing range when the electroslag remelting is carried out, both the melting current and voltage can be set at a constant value. Stated differently, it becomes possible to control a melting rate through adjustment of the number of revolutions without a need of changing voltage as well as current.

The process of electroslag remelting can be started generally by a cold starting method or a hot starting method. Either method is applicable to this invention.

In the cold starting method, chips and flux are first inserted into the bottom of the empty space and then an arc is generated between the leading end of the consumable electrode material and the chips, so as to melt the flux and produce a slag bath. When started with this method, rotation of the steel ingot from the beginning of start-up frequently leads to break-off of the arc once generated and makes it hard to come into starting. From this reason, the steel ingot is preferably rotated after the starting has been completed and then the slag bath has been formed. In case of rotating the collecting electrodes, they may be rotated from the beginning of start-up.

As for the hot starting method, a slag bath having been prepared separately is charged into the bottom of the empty space, then the consumable electrode is inserted into the slag bath and then starting is set forth. Since no arc is generated in this method, there occurs no trouble even by rotating the steel ingot or the collecting electrodes from the beginning of start-up.

It is quite preferable to rotate the slag bath at the same time, in addition to the movement of the flow path of electric current passing from the consumable electrode to the collecting electrodes in the circumferential direction of the steel ingot. With this, the uniformity in horizontal fusion of the steel ingot can be further improved.

In this connection, the method causing rotation of the steel ingot can realize both movement of the flow path of electric current and rotation of the slag bath at the same time. Thus, it is a highly desirous method. From this reason, it is recommended when practicing this invention that the hot starting method is adopted and the steel ingot is rotated from the beginning of start-up.

Rotation of the slag bath can also be effected by disposing an electromagnetic coil round the empty space and by utilizing a magnetic field which is excited by the action of both a melting current and an exciting current applied to pass through the electromagnetic coil. One concrete method utilizing the external magnetic field is disclosed in Japanese Patent Publication No. 56-50658 by way of example.

The intensity of the external magnetic field is preferably located in a range of 50–1000 gauss. If that intensity is less than 50 gauss, a rotational force of the slag bath is reduced and this results in such a fear that the effect on uniformity in fusion depth of the steel ingot will be insufficient. If the intensity of external magnetic field is greater than 1000 gauss, the surface of the slag bath is fluctuated in the form of a wave and fusion may become unstable. A rotational speed of the slag bath can be controlled through adjustment of the intensity of the external magnetic field. Further, the intensity of the external magnetic field can be in turn controlled by adjusting a level of the exciting current which is applied to pass through the electromagnetic coil.

The method utilizing the external magnetic field to rotate the slag bath is suitable for such a case that the collecting electrodes are rotated to move the flow path of the electric current.

In the process of electroslag remelting, as the surface or height of the slag bath is raised, a fusion depth of the steel ingot in the circumferential direction is increased gradually. In order to prevent such a gradual increase in fusion depth of the steel ingot from the bottom to the top thereof, it is preferred to increase the rotational speed of the slag bath continuously or stepwisely in accordance with a rise in the filled height of the molten metal. It has been found that when a rotational speed of the slag bath is increased, the heat transfer rate between the slag bath and the consumable electrode is improved so that the melting rate of the consumable electrode becomes higher to increase a rising speed of the surface of the slag bath. As a result, with an increase in rotational speed of the slag bath, an inlet caloric value into the steel ingot is decreased, thereby to prevent an excessive fusion depth of the steel ingot.

A rotational speed of the slag can be increased by enlarging the number of revolutions of the steel ingot, or by applying an external magnetic field to the slag bath so as to increase the intensity of the magnetic field. In case of adopting both methods at once, it is preferred to increase either one of those two variables continuously or stepwisely with a rise in the surface of the slag bath, while holding the other variable at a constant value. By so doing, a rotational speed of the slag bath can be controlled more easily.

In order that a flow path of the electric current passing from the consumable electrode to the collecting electrodes is moved in the circumferential direction of the steel ingot, and at the same time a rotational speed of the slag bath is increased with a rise in the surface of the slag bath, the following methods (a) to (e) are applicable by way of examples:

(a) the steel ingot is rotated and its rotational speed is gradually increased with a rise in the surface of the slag bath, (b) the collecting electrodes are rotated, an external magnetic field is applied to the slag bath, and then its intensity is gradually increased, (c) both the collecting electrodes and the steel ingot are rotated, and the rotational speed of the steel ingot is gradually increased with a rise in the surface of the slag bath, (d) the steel ingot is rotated, an external magnetic field is applied to the slag bath, and then at least one of the rotational speeds of the steel ingot and the intensity of the external magnetic field is gradually increased with a rise in the surface of the slag bath, and (e) both methods (a) and (b) are used combinedly, and at least one of the rotational speeds of the steel ingot and the intensity of the external magnetic field is gradually increased.

In case of adopting the cold starting method, it is preferable that the collecting electrodes are rotated at the beginning of start-up, and then the steel ingot is rotated or an external magnetic field is applied to the slag bath after forming of the slag bath.

Incidentially, when the slag bath is rotated by turning the steel ingot, the molten metal is also rotated at the same time, but this causes no trouble.

In case of increasing the number of revolutions of the steel ingot with a rise in the surface of the steel ingot, it is preferred that a relationship between a melting rate of the consumable electrode or a rising speed of the surface of the slag bath and a height of the steel ingot as well as a relationship between a melting rate of the consumed electrode or a rising speed of the surface of the slag bath and the number of revolutions of the steel ingot, necessary for attaining a predetermined fusion depth, have been obtained in advance based on experiments, heat transfer calculations, etc., and that the number of revolutions of the steel ingot is increased in accordance with programs which represent those relationships.

Figure 1:
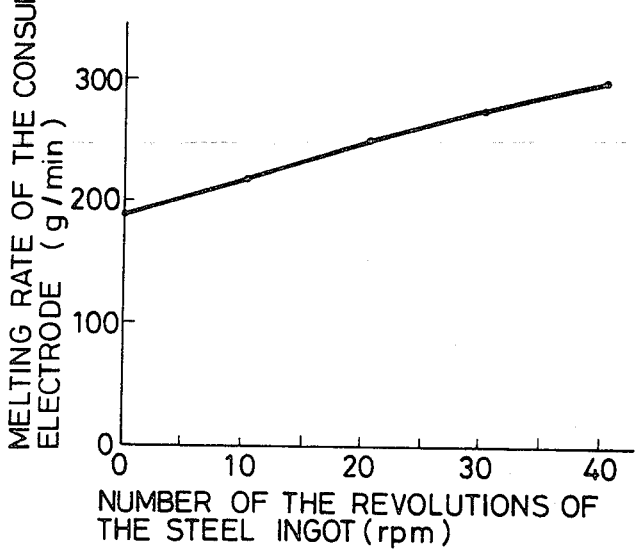
FIGS. 1 and 2 are characteristic views showing a relationship between a melting rate of the consumable electrode and the number of revolutions of the steel ingot.
Figure 2:
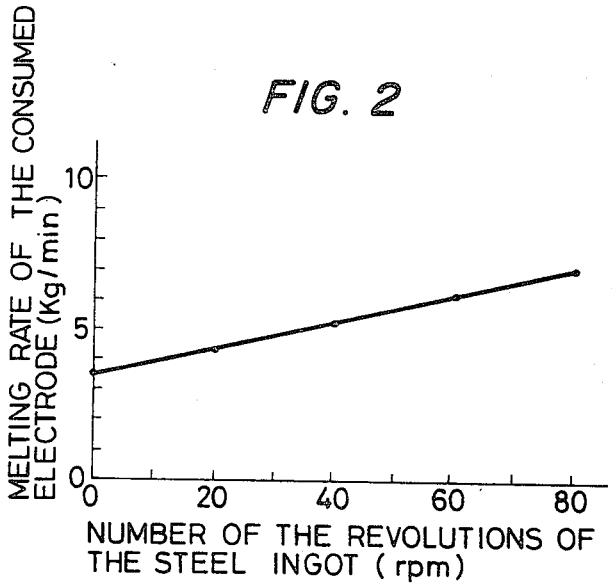

The actual relationships between a melting rate of the consumable electrode and the number of revolutions of the steel ingot, which were attained through experiments are shown in FIG. 1 as for an inward pad and in FIG. 2 as for an outward pad, respectively. Data shown in FIG. 1 were obtained from such conditions that voltage and current were set at a constant value 30 V and 900 A, respectively; slag consisting of calcium fluoride of 40 weight %, calcium oxide of 30 weight % and alumina of 30 weight %; the consumable electrode was formed of a nickel-chromium-molybdenum steel JIS G 4103-SNCM 8 with a diameter of 30 mmϕ and a length of 1300 mm; and the hollow steel ingot was formed of a 0.9 weight % carbon—3 weight % chromium steel with an inner diameter of 57 mmϕ, an outer diameter of 140 mmϕ and a height of 400 mm. Data shown in FIG. 2 were obtained from such conditions that voltage and current were set at a constant value 30 V and 4000 A, respectively, and the consumable electrode as well as the cylindrical steel ingot had the same compositions as those in case of the inward pad. But, unlike the foregoing case, the consumable electrode had a cylindrical shape with an inner diameter of 237.2 mmϕ, an outer diameter of 267.4 mmϕ and a height of 3500 mm, while the steel ingot had a diameter of 200 mmϕ and a height of 800 mm. Outside of the steel ingot there was disposed a mold made of copper which had a diameter of 320 mm and a height of 725 mm.

As will be apparent from FIGS. 1 and 2, with both current and voltage being held constant, a melting rate of the consumable electrode is increased linearly with an increase in the number of revolutions of the steel ingot. Thus, the melting rate of the electrode can be controlled by adjusting the number of revolutions of the steel ingot.

In case of adopting the method where the slag bath is rotated by the action of the external magnetic field to regulate a fusion depth of the steel ingot in the direction corresponding to a filled height of the molten metal, it is preferred to prepare a program beforehand which represents a relationship between a melting rate of the electrode or a rising speed of the surface of the slag bath and a height of the steel ingot, as well as another program which represents a relationship between a rising speed of the surface of the slag bath or a melting rate of the electrode and an amount of exciting current made to pass through the electromagnetic coil.

The apparatus for manufacturing composite steel ingots of this invention comprises; a surface plate on which is placed a steel ingot having a concentric empty space; a consumable electrode inserted into the empty space; a plurality of collecting electrodes connected electrically with the outer periphery of the surface plate or the steel ingot; a power supply unit for applying electric power to both the consumable electrode and the collecting electrodes; and a means adapted to rotate at least either one of the steel ingot and the surface plate in the circumferential direction thereof.

Figure 3:
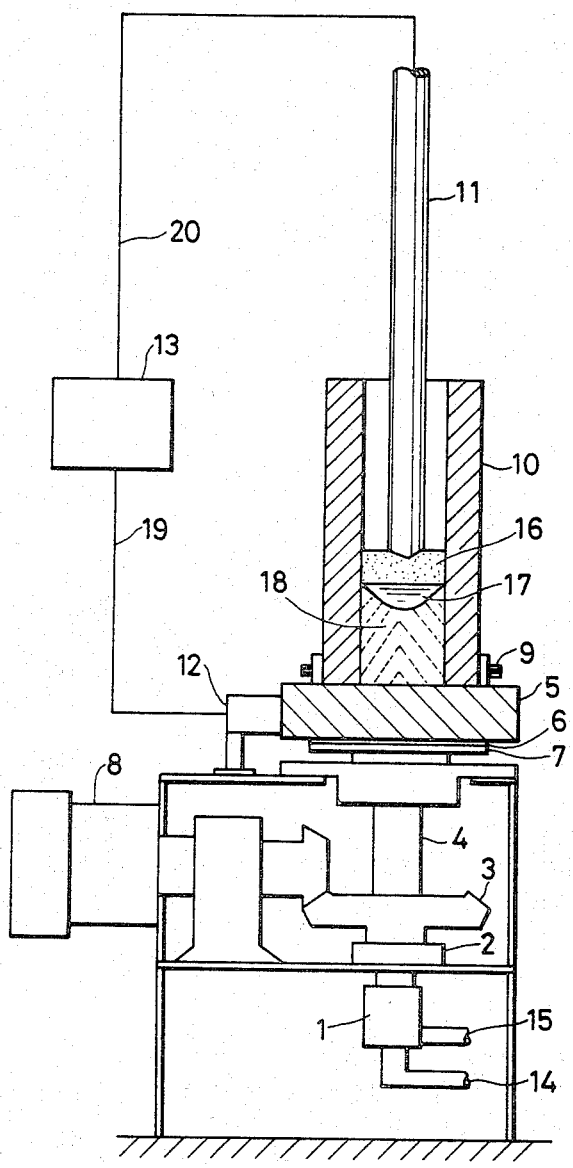
FIG. 3 is a side view of the electroslag remelting apparatus used in this invention.

FIG. 3 shows a construction of the apparatus by way of example, which is used to practice the method of this invention.

There is provided a surface plate 5 on which a steel ingot 10 is placed. A plurality of collecting brushes 12 serving as collecting electrodes are mounted on the side of the surface plate 5. The surface plate 5 is rotated by means of a motor 8 through a pipe 4 and a gear 3. The collecting brushes 12 are made not to rotate synchronously with the surface plate 5, when it is rotated. It is preferable for the surface plate 5 to have a water cooling structure. When the surface plate 5 is made to have a water cooling structure, it is practicable, for example, that cooling water is fed from a water supply pipe 14 to the surface plate 5 through the pipe 4 and then is discharged from a drainpipe 15 through the pipe 4 after circulation in the interior of the surface plate 15. In this case, the pipe 4 has the structure of a double-walled pipe for supply of cooling water as well as discharge thereof. Designated at the reference numeral 1 is a rotary joint, 2 is a flange, 6 is an insulative plate, and 7 is a holding plate for the insulative plate. One end of a cable 19 is connected to the collecting electrodes, while the other end thereof is connected to a power supply unit 13. The power supply unit 13 is composed of a multiphase AC power source, for example. After being placed on the surface plate 5, the steel ingot 10 is preferably rigidly fixed in place by means of fixtures 9.

In this state, the process of electroslag remelting is started in accordance with a hot starting method or a cold starting method. More specifically, one end of the consumed electrode 11 is immersed in a slag bath 16, and the other end thereof is connected to a cable 20. Then, the cable is connected to the power supply unit 13. The consumable electrode 11 is fused into a molten metal due to resistance heat of the slag bath so as to form a molten metal bath 17 at the bottom of the slag bath 16. The molten metal turns to a solidified metal 18, thereby to fill the empty space of the steel ingot gradually. Since the height of the surface of the slag bath is raised with the progressive melting of the consumable electrode, a rotational speed of the steel ingot is made to increase correspondingly. A rotational speed of the steel ingot can be controlled by adjusting an electromotive force.

In the above-mentioned apparatus, only the surface plate was movable, but it is possible to rotate the collecting brushes too separately from the surface plate.

EXAMPLES

Example 1

A cylindrical steel ingot formed of a chromium-molybdenum-vanadium steel with an inner diameter of 270 mmϕ, an outer diameter of 1000 mmϕ and a height of 1700 mm was placed on the surface plate. The process of electroslag remelting was carried out using a consumable electrode formed of a chromium-molybdenum-vanadium steel with a diameter of 160 mmϕ and a slag which consisted of calcium fluoride of 40 weight %, calcium oxide of 30 weight % and alumina of 30 weight %. Four collecting electrodes were provided at equally spaced intervals on the outer periphery of the surface plate. Voltage and current were set at 35 V and 8 kA, respectively, and the number of revolutions of the cylindrical steel ingot was set at 10 rpm at the beginning. In the course of the process, a melting rate of the consumable electrode was detected and a rotational speed of the steel ingot was increased based on the detected result, so that it become equal to the melting rate preset in advance. A rotational speed of the steel ingot was increased stepwise to reach 40 rpm finally. A width of the fused layer was measured in the transversal and longitudinal sectional surfaces of the thus attained composite steel ingot. As a result, it was confirmed that each measured width was substantially uniform, and it was clarified that the attained composite steel ingot has good quality.

Example 2

A consumable electrode formed of a nickel-chromium-molybdenum steel SNCM8 with a diameter of 30 mmϕ was inserted into an empty space of the cylindrical steel ingot formed of a 0.9 weight % carbon—3 weight % chromium steel with an inner diameter of 57 mmϕ, an outer diameter of 140 mmϕ and a height of 320 mm. In this state, the process of electroslag remelting was carried out. As for slag, there was used a slag consisting of calcium fluoride, calcium oxide and alumina and having the same composition as that used in the Example 1. Four collecting electrodes were provided at substantially equal intervals on the outer periphery of the surface plate. Voltage and current were set at 30 V and 900 A, respectively, and starting of refusion was set forth in accordance with the cold starting method. The steel ingot was started to rotate at the time when the height of the surface of the slag bath reached 150 mm. The number of revolutions of the steel ingot was set at 15 rpm at the beginning and then it was set at 25 rpm at the time when the height of the surface of the slag bath reaches 240 mm. The process of refusion was completed with the number of revolutions of the steel ingot being held at 25 rpm unchangedly.

Figure 4:
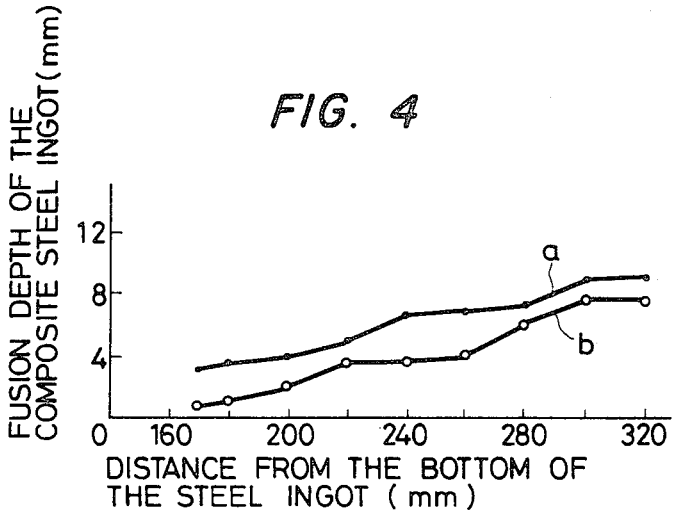
FIGS. 4 to 7 are characteristic views showing a relationship between a fusion depth of the composite steel ingot and a distance from the bottom of the steel ingot.

The resulting composite steel ingot was divided into halves in the axial direction, and a fusion depth of the matrix was measured. FIG. 4 shows a fusion depth a in the right-hand portion and a fusion depth b in the left-hand portion, respectively. It is apparent that the composite steel ingot of this examle has superior uniformity in fusion depth of the steel ingot in both the horizontal and vertical directions, in comparison with the following comparative example 1 where the process of refusion was carried out under the same conditions as those in this example except that the steel ingot was not rotated.

Comparative Example 1

Figure 5:
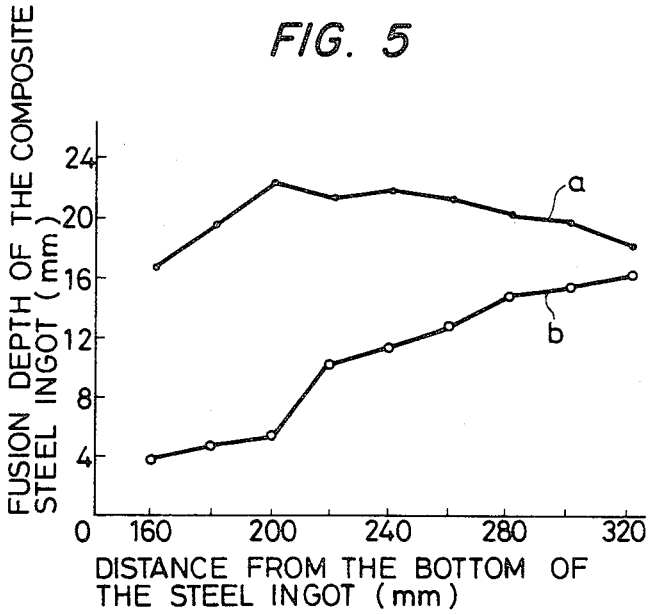

The process of electroslag remelting was carried out under the same conditions as those in the above Example 1 except that the steel ingot was not rotated. FIG. 5 shows the resulted relationship between a height of the fused portion from the bottom of the steel ingot and a fusion depth thereof.

EXAMPLE 3

Figure 6:
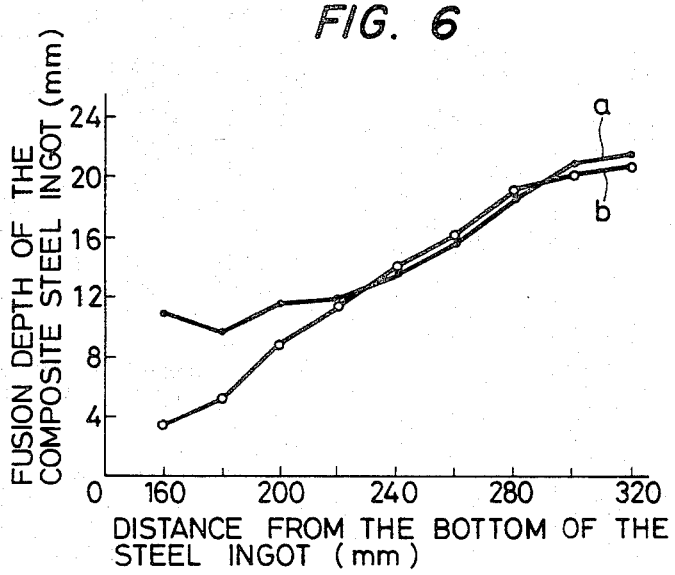

The process of electroslag melting was carried out under the same conditions as those in the above Example 2. But the number of revolutions of the steel ingot was held at 10 rpm at all times. FIG. 6 shows the resulted relationship between a height of the fused portion from the bottom of the steel ingot and a fusion depth thereof. As will be apparent from comparison with Comparative Example 1, uniformity in horizontal fusion depth of the steel ingot was improved so much.

Example 4

Figure 7:
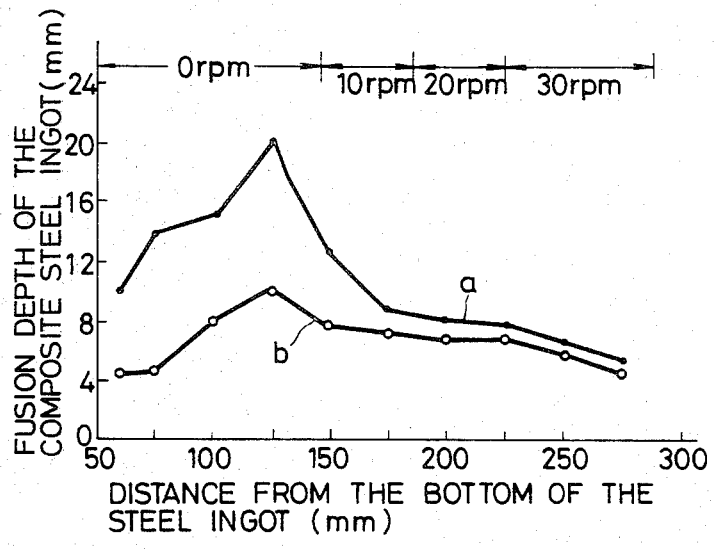

The process of electroslag remelting was carried out under the same conditions as those in the above Example 2 except that the method of rotating the steel ingot was changed. A program which represents a relationship between a melting rate of the consumed electrode and a height of the steel ingot as well as another program which represents a relationship between the number of revolutions of the steel ingot and a melting rate of the consumed electrode had been prepared in advance, and the number of revolutions of the steel ingot was varied stepwisely in accordance with both those programs. FIG. 7 shows the resulted relationship between a distance from the bottom of the steel ingot and a fusion depth thereof. The time points when the number of revolutions of the steel ingot was changed are shown in the figure. It is apparent that uniformity in fusion depth of the steel ingot was improved in both the horizontal and vertical directions.

Example 5

In the method of Example 2, an external magnetic field was applied in combination with rotation of the steel ingot. Rotation of the steel ingot was started at a constant speed of 10 rpm after the height of the surface of the slag bath had reached 150 mm. At the same time of starting to rotate the steel ingot, an external magnetic field was applied and its intensity was increased from 100 gauss to 230 gauss continuously and linearly.

Uniformity in fusion depth of the thus attained composite steel ingot was substantially the same as that shown in FIG. 4 in both circumferential and vertical directions.

As will be apparent from the above-mentioned examples, uniformity in horizontal fusion depth of the steel ingot can be improved by rotating the steel ingot in the circumferential direction thereof. Furthermore, uniformity in fusion depth of the steel ingot in both the horizontal and vertical directions can be also improved by increasing a rotational speed of the steel ingot with a rise in the surface of the slag bath, or by changing the intensity of an applied external magnetic field while rotating the steel ingot at a constant value.

According to this invention, as described in the above, it becomes possible to improve uniformity in the horizontal fusion depth of the composite steel ingot as well as uniformity of the fusion depth thereof in both the horizontal and vertical directions.

We claim:

1. A method of manufacturing a composite steel ingot comprising locating a steel ingot having an empty space positioned concentrically therein on a surface plate, having a plurality of collecting electrodes electrically connected thereto in spaced relation, inserting a consumable electrode into the empty space of said steel ingot, feeding electric power to said comsumable electrode to effect electroslag remelting under a slag bath, and then solidifying the molten metal while taking out an electric current through said plurality of collecting electrodes which are electrically connected to said steel ingot placed on the surface plate, wherein a flow path of the electric current passing from said consumable electrode to said collecting electrodes is moved in the circumferential direction of said steel ingot during said electroslag remelting.

2. A method of manufacturing a composite steel ingot according to claim 1, wherein said steel ingot is rotated in the circumferential direction thereof during said electroslag remelting to effect said movement of the electric current flow path.

3. A method of manufacturing a composite steel ingot according to claim 1, wherein said collecting electrodes are rotated in the circumferential direction of said steel ingot during said electroslag remelting to effect said movement of the electric current flow path.

4. A method of manufacturing a composite steel ingot according to claim 1, wherein the distance from the wall surface of said empty space to said consumable electrode is 20 mm at minimum.

5. A method of manufacturing a composite steel ingot according to claim 4, wherein a spacing D of said empty space and a horizontal thickness d of said consumed electrode meet the relationship of $d/D=0.2\sim0.8$.

6. A method of maunfacturing a composite steel ingot according to claim 2 or 3, wherein the number of revolutions N (rpm) of said steel ingot or said collecting electrodes and a spacing L (cm) of said empty space at the inward pad of said hollow steel ingot meet the relationship of $60\leqq LN\leqq 2000$.

7. A method of manufacturing a composite steel ingot according to claim 2 or 3, wherein the number of revolutions N (rpm) of said steel ingot or said collecting electrodes and a horizontal diameter L (cm) of said steel ingot at the outward pad thereof meet the relationship of $60\leqq LN\leqq 2000$.

8. A method of manufacturing a composite steel ingot according to claim 6, wherein said number of revolutions N (rpm) and a spacing L (cm) of said empty space meet the relationship of $60\leqq LN\leqq 240$.

9. A method of manufacturing a composite steel ingot according to claim 7, wherein said number of revolutions N (rpm) and a horizontal diameter L (cm) of said steel ingot meet the relationship of $180\leqq LN\leqq 720$.

10. A method of manufacturing a composite steel ingot according to claim 1, wherein said steel ingot is rotated in the circumferential direction thereof in combination with rotation of said collecting electrodes in the circumferential direction of said steel ingot during said electroslag remelting.

11. A method of manufacturing a composite steel ingot according to claim 2, wherein said electroslag remelting is started by inserting the separately prepared slag bath into said empty space.

12. A method of manufacturing a composite steel ingot comprising inserting a consumable electrode into an empty space of a steel ingot, said empty space being positioned concentrically with said steel ingot, and feeding electric power to said consumable electrode to effect eletroslag remelting under a slag bath, while taking out an electric current through a plurality of collecting electrodes which are electrically connected to said steel ingot, wherein said slag bath is rotated in the circumferential direction and a flow path of the electric current passing from said consumable electrode to said collecting electrodes is moved in the circumferential direction of said steel ingot during said electroslag remelting.

13. A method of manufacturing a composite steel ingot according to claim 12, wherein said steel ingot is rotated in the circumferential direction thereof during said electroslag remelting.

14. A method of manufacturing a composite steel ingot according to claim 12, wherein said collecting electrodes are rotated in the circumferential direction of said steel ingot during said electroslag remelting.

15. A method of manufacturing a composite steel ingot according to claim 14, wherein said slag bath is made to rotate by rotating said steel ingot.

16. A method of manufacturing a composite steel ingot according to claim 14, wherein an external magnetic field is applied to said slag bath so that said slag bath is rotated by virtue of a magnetic field excited by both a melting current and said external magnetic field.

17. A method of manufacturing a composite steel ingot according to claim 16, wherein the intensity of said external magnetic field is in a range of 50 to 1000 gauss.

18. A method of manufacturing a composite steel ingot comprising inserting a consumable electrode into an empty space of a steel ingot, said space being positioned concentrically with said steel ingot; feeding electric power to said consumable electrode to effect electroslag remelting under a slag bath, while taking out an electric current through a plurality of collecting electrodes which are electrically connected to said steel ingot, wherein a flow path of the electric current passing from said consumable electrode to said collecting electrodes is moved in the circumferential direction of said steel ingot during said electroslag remelting, and wherein said slag bath is rotated in the circumferential direction during electroslag remelting with the rotational speed of said slag bath being increased with a rise in the surface of said slag bath.

19. A method of manufacturing a composite steel ingot according to claim 18, wherein both rotation of said slag bath and movement of said flow path of the electric current are made by rotating said steel ingot in the circumferential direction thereof, and a rotational speed of said steel ingot is increased with a rise in the surface of said slag bath.

20. A method of manufacturing a composite steel ingot according to claim 18, wherein the movement of said flow path of the electric current is made combinedly by rotating said collecting eletrodes in the circumferential direction of said steel ingot as well as by rotating said steel ingot in the circumferential direction thereof, and a rotational speed of said steel ingot is increased with a rise in the surface of said slag bath.

21. A method of manufacturing a composite steel ingot according to claim 19, wherein the rotation of said slag bath is made combinedly by rotating said steel ingot in the circumferential direction thereof as well as by applying an external magnetic field to said slag bath and then utilizing a magnetic field which is excited by both a melting current and said external magnetic field, and at least either one of a rotational speed of said steel ingot and the intensity of said external magnetic field is increased along with a rise in the surface of said slag both.

22. A method of manufacturing a composite steel ingot according to claim 21, wherein the movement of said flow path of the electric current is made combinedly by rotating said collecting electrodes in the circumferential direction of said steel ingot as well as by rotating said steel ingot in the circumferential direction thereof.

23. A method of manufacturing a composite steel ingot according to claim 18, wherein the movement of said flow path of the electric current is made by rotating said collecting electrodes in the circumferential direction of said steel ingot, the rotation of said slag bath is made by applying an external magnetic field to said slag bath and then utilizing a magnetic field which is excited by both a melting current and said external magnetic field, and the intensity of said external magnetic field is increased with a rise in the surface of said slag bath.

* * * * *